United States Patent [19]

Beierling et al.

[11] Patent Number: 4,587,927

[45] Date of Patent: May 13, 1986

[54] PAINTING- AND EVAPORATION CABIN WITH AIR-RETURN VENTILATION

[75] Inventors: Klemens Beierling, Paderborn-Neuenbeken; Hans-Jurgen Beierling, Gromitz, both of Fed. Rep. of Germany

[73] Assignee: RMG-Beierling GmbH, Industriestr, Altenbeken-Buke, Fed. Rep. of Germany

[21] Appl. No.: 650,328

[22] Filed: Sep. 12, 1984

[30] Foreign Application Priority Data

Sep. 22, 1983 [DE] Fed. Rep. of Germany ..... 3334257

[51] Int. Cl.[4] ..... B05B 15/12

[52] U.S. Cl. ..... 118/326; 98/115.2

[58] Field of Search ..... 98/115.2; 118/326

[56] References Cited

U.S. PATENT DOCUMENTS

| | | | |
|---|---|---|---|
| 3,395,972 | 8/1968 | Hardison | 118/326 X |
| 3,890,921 | 6/1975 | Szczepanski | 118/326 X |
| 4,173,924 | 11/1979 | Bradshaw | 118/326 X |
| 4,313,369 | 2/1982 | Tsuruta et al. | 98/115.2 |
| 4,351,863 | 9/1982 | Roesner | 98/115.2 X |

FOREIGN PATENT DOCUMENTS

| | | | |
|---|---|---|---|
| 1183841 | 12/1964 | Fed. Rep. of Germany | 118/326 |

*Primary Examiner*—Shrive P. Beck

*Attorney, Agent, or Firm*—Sprung Horn Kramer & Woods

[57] ABSTRACT

Apparatus for applying of coating material on target objects (11), consisting of at least one painting cabin (10). A conveyor is passing the objects (11) step wise through the cabin (10) and through an adjacent evaporation cabin (30). The painting cabin (10) is divided into two adjacent zones consecutive in the direction of the conveyor movement through which zones air currents (V4*a*, V4*b*) are passed one after the other. Air currents (V2, V5) being drawn from the zones are washed and cleaned in related color particle separator devices (12*a*, 12*b*) and heated with heaters (22,24) above the respective due points. The solvent loaded discharge air currents (V10, V11) are fed from the evaporation cabin (30) into a combustion plant.

The air currents are adjusted in such manner that in the entrance area underpressure exists and a fresh air current (V1) is passing into the cabin (10). A security control and maintainance equipment is described.

7 Claims, 4 Drawing Figures

PAINTING- AND EVAPORATION CABIN WITH AIR-RETURN VENTILATION

The invention deals with a device for applying coatings, e.g. lacquer (varnish) paint on objects, consisting of a painting cabin with forced circulating current of air as well as a device for separation of colour particles.

It is known to ventilate painting- and drying cabins, in order to remove the fog of lacquer and the vaporized solvent which are reflected by the painted surface during the spraying of colour, that the solvent in the discharge air, which leaves the plant accordingly, does not exceed the concentration according to the environmental protection regulations. In this connection it is known from DE-OS No. 30 30 045, to charge a painting cabin several times and to feed a partial current of air as discharge air into a combustion plant after concentration of the air with solvent of the coating material up to a maximum allowable value.

Hereat the disadvantage occurs that a closed-loop control or an ordinary control is necessary which determines the amount of the partial current of air. Furthermore it is necessary that for a coating of an object with several coatings, e.g. several colours, a cabin (booth) and spraying device has to be cleaned time-consumingly. Additionally the cabin can be used only while doors are closed because the highly concentrated solvent vapours would emerge into the open air, therefore an arrangement of a conveyor belt system with open in- and outlet in the cabin would be impossible.

It is the object of the invention to improve the preknown device in such a way that objects could be coated in the painting cabin while its entrance is open, so that a conveyor system can pass it and that solvent vapour does not emerge through the inlet.

This object will be achieved by an apparatus where in the direction of conveying of the objects in the painting cabin or cabins at least two adjacent ventilation zones are arranged and the discharge air of each previous ventilation zone is fed, via a related paint particle separator to the next following ventilation zone or painting cabin and the discharge air, of the last cabin, concentrated with a maximum value of solvent is led to the combustion plant.

An advantageous development of the device consists in that the air is led several times in the zones as air-return current through the painting and evaporation cabin whereby the amount of the discharge air is controlled in such a way that the maximum concentration of solvent reaches the allowable explosion-proofed safety concentration and the number of recirculations in connection with the width of the zones is chosen in such a way that the speed of air within the painting zones is equivalent to a given value and under no circumstances the solvent content of the air exceeds the explosion-proofed concentration limit.

The device offers the advantageous possibility to burn the highly solvent charged, discharge air without pre-heating and use the heat of that burning for the drying process. The heat quantity is of such magnitude, that no further heating energy for the drying plant is necessary.

The colour particle separator with a cleaner, filter and drying device is designed in an advantageous manner. On the one hand continously fog of paint is washed and filtered out of the air having the advantage, that in the painting area depositions of paint which are imflammable and difficult to remove are rarely produced, and further specially for multiple painting or painting with several colours mingling and superimpositions of colours are avoided.

The operation without danger, and safe inspection of the plant is possible through safety circuits and locks at the machines and the entrances.

A maintainance and operation station and a control device are advantageously explosion-proofed equipped and mounted close to the cabin but out-side of it. Therefore it was possible to reduce the base area of the painting cabin considerably whereby the amount of air was also considerably reduced in comparison to common cabins, leading to smaller air -return systems and air cleaning devices.

In FIGS. 1 and 4 are examples of versions of high capacity barrel painting plants for single- or double painting shown.

The painting cabins are chosen in their size to enable a sporadic manipulation at the barrel rotating device. By change of colours or for adjustment of the spraying pistols the barrel rotating devices are removed from the painting cabin. By this means, the high concentration of solvent in the air-return system in the painting cabin is possible, because there is no necessity for an operator to be in this zone permanently. The amount of air which is aimed on to the barrel to avoid a fog of dried paint setteling on the surface of the barrel, is reduced to a technical possible minimum. This air is steadily filtered and cleaned from particles of paint before it is again blown into the painting cabin, to get no reduction of quality at the painted surfaces. During the flow of air through the painting cabin, e.g. the air might be used five times its temperature is risen continously, to prevent a condensation of moisture of the cleaned air on the barrels. The solvent released in the painting area will be absorbed by the air. After the air has reached the last zone in the painting cabin, it will be fed to the evaporating zone. There it will absorb further more solvent and from there it will be fed through the furnace gate like fresh air to furnace. The amount of intake air which cannot be used for fresh air in the furnace, will be led via a by-pass with a separate ventilator directly to a thermal discharge air cleaning. This way it is enabled to feed directly the entire air used in the process of painting charged with the solvent from the painting zones as well as from the evaporating zones to the furnace or thereby also to to a thermal discharge air cleaning device.

Instead of a vertical current of air as shown in the examples a horizontal one can be chosen. For such a device suitably dry filter for paint particle seperators are used.

It is an advantageous version of such painting cabin arrangements to arrange fresh air zones between the painting cabins, where persons have admission to the conveyed objects. The adjoining entrance or way out will be operated by a directed nozzle with air from the air-return system, like it is illustrated at the transition of the evaporation plant, and the amount of discharge air of the adjoining zone is in comparison to the fresh air increased, so that a certain amount of fresh air is sucked in or the solvent vapour is kept out of this zone.

Figure 1:
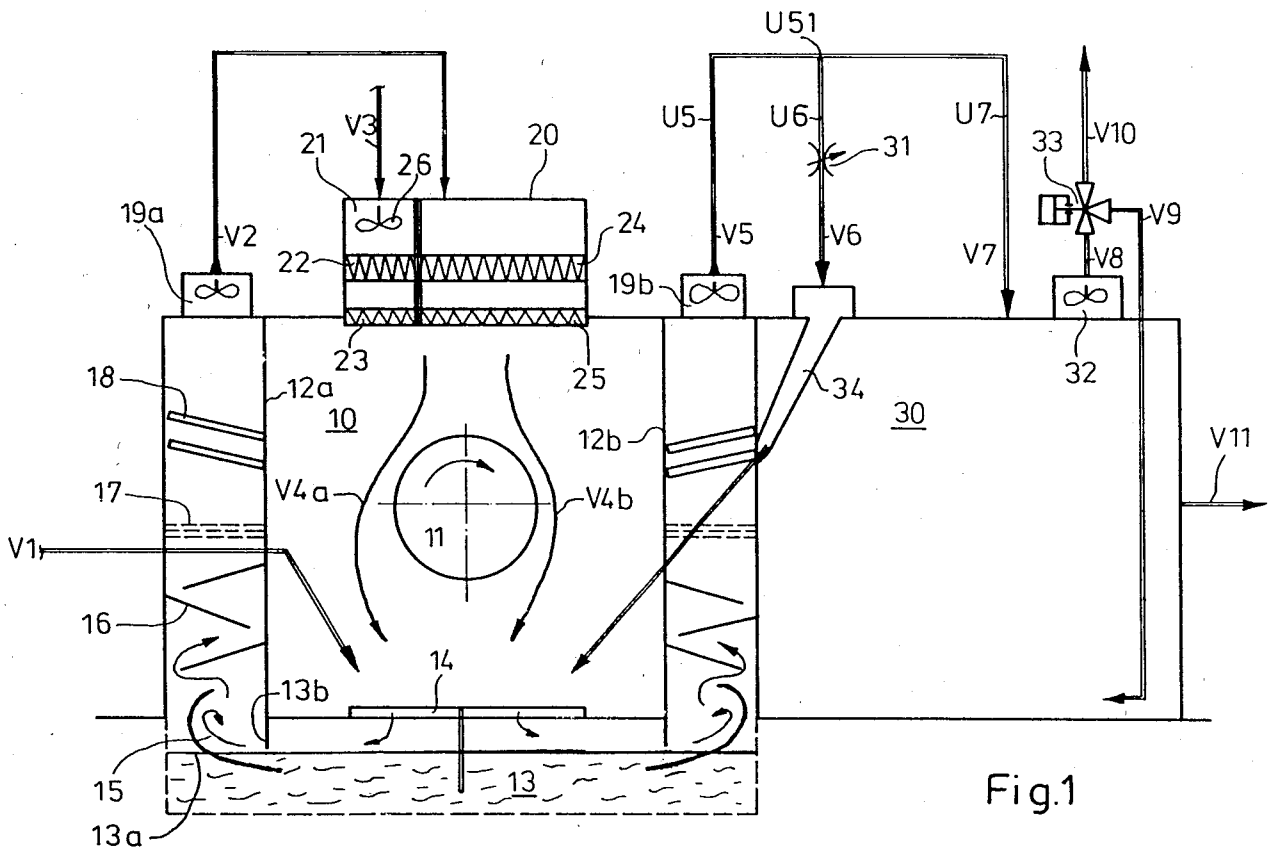
FIG. 1 shows a single cabin painting and evaporating plant with double air-return ventilation in vertical section, shifted in the depth.

In FIG. 1*a* painting and an evaporation cabin 10,30 is shown, in which the objects to be painted 11, which are barrels due to production flow move step wise from the left to the right and from there are led directly to the dry oven. The cleaning towers 12*a,b* for colour particle separation are offset sidewise for the passage of the barrels 11, according to horizontal section FIG. 3 line A—A.

In the position of painting, in which the warm barrel 11 is shown, it rotates during high pressure spraying.

The barrel 11 is surrounded from above to below by currents of air V4*a,b* which have a velocity of 0.05 m/s, to remove the reflected fog of paint. These currents of air of totally 6000 $m^3/h$ consist of 2500 $m^3/h$ fresh air V3 and an air-return current V2 of 3500 $m^3/h$ and they are preheated by heaters 22,24 and are fed by ventilator 21, 19*a* via distribution filters 23, 25 back to the painting cabin 10. A current of fresh air V1 of 1000 $m^3/h$ is drawn in additionly through the cabin entrance, because the throughout of the air-return ventilator 19*a* is higher than the throughput of the fresh air ventilator 21 to keep the solvent vapours in the cabin. The fresh air V3 is fed into the entrance side, and together with this current the air-return current V2 with the smallest load of solvent is drawn out at the entrance half of the cabin floor 14.

A further current of air V5 of 5000 $m^3/h$ is drawn through the right half cabin floor 14 with a ventilator 19*b*, and according to the position of a butterfly valve 31 a partial current of air V4 of it is blown via a directional valve 34 from the evaporating cabin 30 into the painting cabin 10 through the passage, and a second partial current of air V7 of 3500 $m^3/h$ is pressed into the evaporation cabin.

The ventilator V32 sucks out of this evaporation cabin, the highly with solvent enriched discharge air V8 and leads according to a controllable distribution valve 33 a partial current of air V9 back to the evaporation cabin which is now equivalent to output current of air V11 which is drawn into the adjoining drying furnace and it further leads a partial current of air V10 to the solvent combustion plant.

The air-return currents V2, V5 are led away through colour particle separators (cleaning towers) 12*a,b*. The air moves through a grid 14 at the floor of the cabin, passes over the sump 13 up to the edge 13*b* of the cleaning tower which is in accordance with the level 13*a* of the sump surface, the level of which is controlled, whereby the air passes over in vortex motion below the edge into the tower 12*a,b*, the drops of colour are washed out. The drops of water absorbed by the air are seperated by baffle sheets 16 and a filter with holes 17 and other filters 18. The cleaned air is heated in a heater 24 above dew point to such extent that during expansion when leaving the ventilator no condensation occurs. The water in the sump 13 contains a coagulant for fog of colour.

Figure 2:
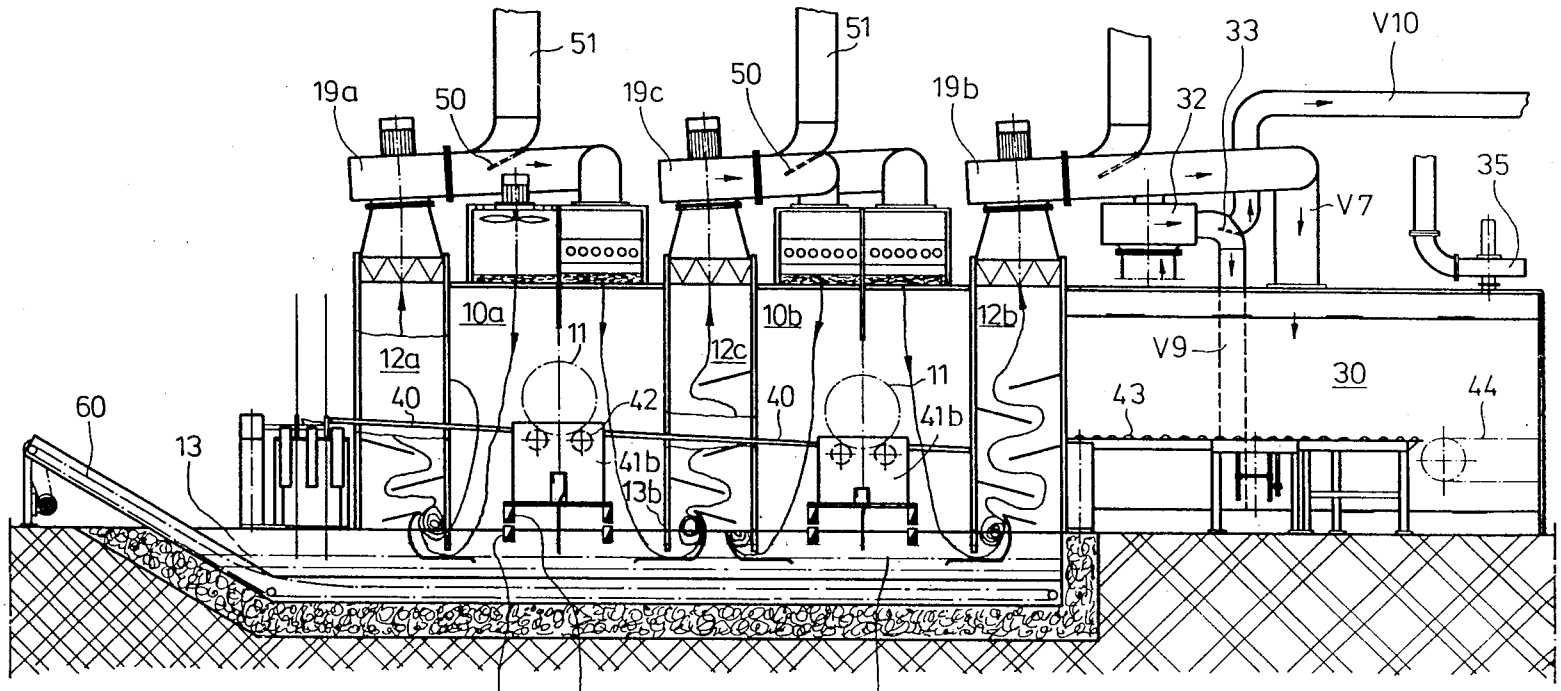
FIG. 2 shows a double cabin painting and evaporating cabin with four times air-return ventilation, in vertical section A—A, shifted in depth.

Further details are shown in FIG. 2, where two painting cabins equipped in the same way are arranged adjacent to each other, whereby the discharge air of the first cabin passes another two times the second cabin. The reference signs are chosen according to FIG. 1 and differ correspondingly by addition of letters. Rails 40 passing the cabins 10*a,b* on which the barrels roll to the next spraying station.

The barrels are placed on the barrel rotating device 41 and they are driven by rolls 42, so that they are painted regularly. In this case different colours are sprayed in seperated strips in both cabins. The strips are marked off sharply by templates placed close to the barrels (not shown) and their function is supported by the discharge of the fog of colour via the air. The barrel rotating devices are equipped with rollers 63 and can be moved out of the cabin along rails 62.

Within the sump 13*a* conveyor belt 60 is moving, which is led out of the sump on one side for removing the colour particles from it.

The barrels are tilted after painting and shifted to a roller conveyor 43 and transfered through the evaporation zone in cycles, until they are moved by a conveyor belt 44 through the drying oven.

Behind each ventilator 19*a,b,c* are vent valves 50 located which are controllable by a signal S19. In case a cleaning of the plant is necessary these valve enables a quick deaeration into the discharge pipes. The position of the valves will be given to control device 70 via a sensing element and signalling line M50.

Figure 3:
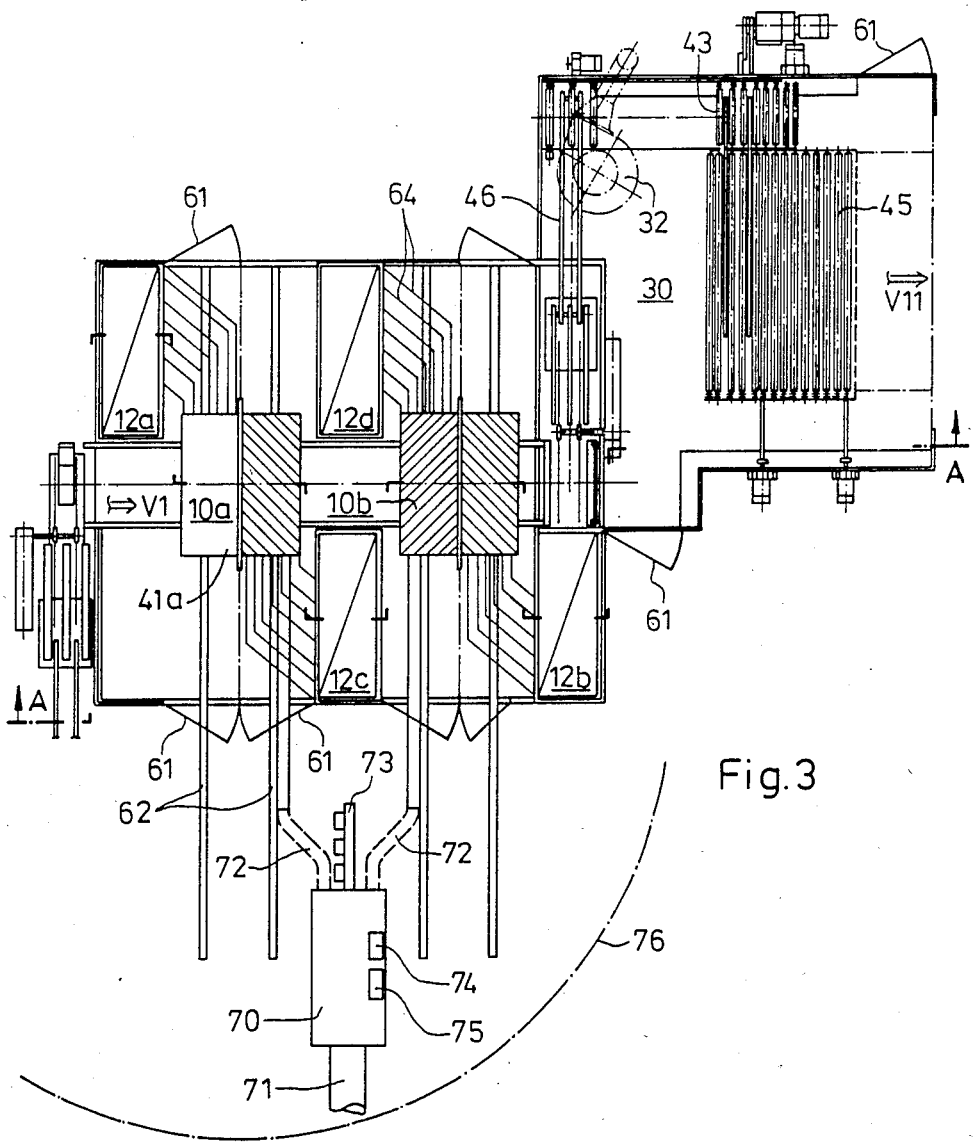
FIG. 3 shows a horizontal section of the plant, due to FIG. 2 in reduced scale with maintainance and operation station.

FIG. 3 shows a horizontal view of the plant of FIG. 2, from there it is seen the four cleaning towers 12*a* to 12*d* are set off sidewise to alternate sides from the painting cabins and the conveyor path of the barrels. The air guidances 64 lead the air of the particular zone to the respective cleaning tower. The cabin is equipped with safety doors 61 to be operated in case inspections are necessary or when the barrel rotating device 41*a,b* should be moved out of the cabin, the safety doors can be opened from inside anytime but from outside only if the locking of the door is removed by a control signal S61 of the control device 70. Additionally all doors 61 are controlled by locking control, its signal M61 is analysed by the control device 70.

The control device is arranged in a cabinet adjoining to the painting cabin between the maintainance places of the barrel rotating devices. It carries a control and operation desk 73, from where the functions and signals of the spraying pistols, the conveyor drives, the ventilators and valve drives are controlled and received via pneumatic lines and cables 72.

To be explosion-proofed the cabinet must be air-tight and it is supplied from outside of the safety zone 63 with compressed air by a pressure control valve 74 which is controlled by manostat, so that no solvent carrying air could enter and explosions cannot occur. This solution represents an independent invention.

At the entrance to the evaporation cabin 30 the drum tilting device and the conveyor system 46 are located. The roller conveyor 43 works step by step and from there the objects are transfered to a 4-times parallel roller conveyor 45 running accordingly slower on which the evaporation happens.

When the plant runs with full spraying capacity 3500 $m^3/h$ discharge air with a concentration of 20 $g/m^3$ solvent are emitted, meaning a caloric equivalent of 50 $m^3/h$ of fuel gas. When thicker coatings are sprayed higher concentrations, e.g. 30 $g/m^3$ can be yielded.

Figure 4:
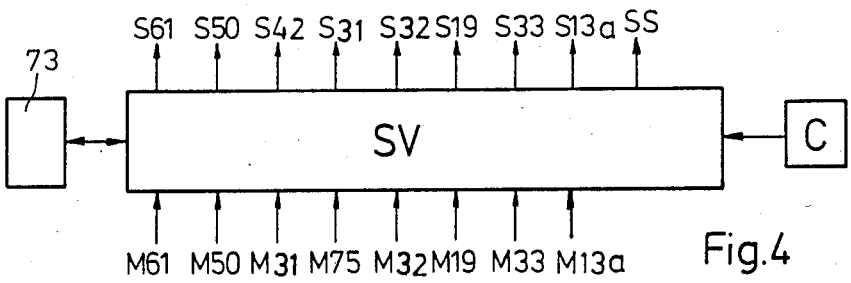
FIG. 4 shows a lay-out of control device with safety circuitry and connection.

In FIG. 4 the control device 70 is shown schematically. It is in connection with the controll display- and operation desk 73 and is controlled by the master clock C. Further more it receives the sensing signals on sensorlines Mx which are delivered by given elements x with their respective reference signs, and which gives the control signals Sx which are also named with respective reference signs, replacing the x.

Before putting the spraying pistols into operation with signal SS the following informations have to be checked: doors closed M61, discharge valves closed M50, ventilators 19,32 in operation M19, M32; cabinet under pressure M75, and water level existing M13. If one of these conditions is not fulfilled spraying will not be started or it will be interrupted.

If an inspection of the plant is wanted, then the spraying will be stopped by dismissing signal SS and deaeration is opened by signal S50.

The ventilators are still in operation via signals S19 and S32. It the predetermined safety time is fixed for working with signals M19, M32, then the locking of the doors is released with signal S61.

Additionally the pressure adjustment valve 74, the conveyor drive, the butterfly valves 31,33 and the water level 13*a* are controlled and checked by signals M74, MT, M31, M33, M13*a*, whereby an absolutely safe operation of the plant is guaranteed.

We claim:

1. Apparatus for spraying a coating material on objects, comprising: at least two painting cabins adjacent to each other and having open inlets and outlets an object conveyor for passing objects through the cabins via the inlets and outlets; color particle separators; ventilation means for feeding air flows via the color particle separators to the cabins and feeding a fresh air flow to cabins to effect a forced air circulation crossing the cabin comprising means dividing each cabin into at least two ventilation zones adjacent to each other in the direction of the conveyor movement, a first ventilator feeding fresh air into the zone adjacent to the inlet being the entrance zone, a second ventilator feeding the air flow leaving the entrance zone via a first separator to the adjacent second zone, a third ventilator feeding the air flow leaving the second zone via the second separator to the first zone of the second cabin, a fourth ventilator feeding the air flow of the first zone of the second cabin via a third separator to the second zone of the second cabin and a fifth ventilator feeding the air flow of the second zone leaving the second cabin via a fourth separator to a combustion plant and wherein the first ventilator feeds a smaller fresh air flow via the entrance zone than the second ventilator draws from it, whereby an underpressure occurs in the entrance zone and a fresh air flow enters the first cabin via the inlet thereof.

2. Apparatus according to claim 1, wherein the last painting cabin in direction of conveyor movement is connected with an open passage to an evaporation plant and wherein the discharge air out of the last painting cabin is fed to the evaporation plant via a color particle separator, and further comprising a controllable butterfly valve and a directed nozzle inclined from top against the passage of the painting cabin into the evaporation plant to feed a partial current from the discharge air to the last painting cabin, and wherein the discharge air of the evaporation plant is fed to the combustion plant.

3. Apparatus according to claim 2, further comprising a discharge air ventilator connected to the evaporation plant and having an output line including a controllable distribution valve for distributing a current of air into an air-return line and a discharge line.

4. Apparatus according to claim 1, further comprising a barrel rotating device in the painting cabins disposed in a working position therein and including a drive for a barrel and rolls supporting the barrel rotating device on rails to lead same through a safety door out of the cabin and into a maintenance position adjoining the painting cabin.

5. Apparatus according to claim 1, wherein each color particle separator comprises a cleaning device with a water vortex, water separators including baffle plates, hole filters and a fiber filter, and wherein a ventilator is placed consecutive to each separator and with a heater disposed at the output side of the ventilation to heat the air above the dew point of the painting cabin and zone.

6. Apparatus according to claim 1, further comprising controllable ventilation valves disposed in the air-return lines, to interrupt the air-return current and to lead same to a deaeration line and wherein the ventilation valves have positional sensing elements for signalling a control device.

7. Apparatus according to claim 4, further comprising a control device adjoining the maintenance position and having a display and operation desk.

* * * * *